United States Patent [19]

Ulrich et al.

[11] Patent Number: 4,579,551

[45] Date of Patent: Apr. 1, 1986

[54] CARTON ERECTOR APPARATUS

[75] Inventors: Lawrence W. Ulrich, Cicero; Connie W. Walker, Bolingbrook, both of Ill.

[73] Assignee: Durable Packaging Corporation, Chicago, Ill.

[21] Appl. No.: 590,073

[22] Filed: Mar. 15, 1984

[51] Int. Cl.[4] ..... B31B 1/80; B31B 5/74

[52] U.S. Cl. ..... 493/23; 493/183; 493/316

[58] Field of Search ..... 493/317, 316, 313, 309, 493/183, 23

[56] References Cited

U.S. PATENT DOCUMENTS

| | | | |
|---|---|---|---|
| Re. 27,631 | 5/1973 | Berney | 493/313 |
| 2,289,820 | 7/1942 | Ardell | 493/316 |
| 2,827,838 | 3/1958 | Pearson et al. | 493/316 |
| 3,739,696 | 6/1973 | Pearson | 493/316 |
| 3,911,799 | 10/1975 | Klund | 493/313 |
| 4,285,682 | 8/1981 | Moss | 493/316 |

*Primary Examiner*—Francis S. Husar
*Assistant Examiner*—William E. Terrell
*Attorney, Agent, or Firm*—Dressler, Goldsmith, Shore, Sutker & Milnamow, Ltd.

[57] ABSTRACT

A carton erector apparatus for setting up folding carton blanks and unfolding their bottom flaps. The apparatus includes a carton blank storage section, a carton blank set-up section and a bottom flap folding section. The carton blank storage section includes a magazine assembly for storing and urging knocked-down carton blanks towards the carton set-up section. The carton set-up section includes a carton opening assembly mounted on a substantially horizontal carriage plate movable in a direction transverse to the direction of movement of the carton blanks in the magazine assembly. A pivot arm assembly is pivotally secured to the folding arm assembly and is movable between first and second position respectively parallel and perpendicular to the folding arm assembly. A suction cup is secured to the pivot arm assembly to grasp the side panel of the forward carton in the magazine assembly when the pivot arm assembly and the folding arm assembly into their second positions is effective to set-up the carton blank into a tubular form. Bottom flap folding plough bars are provided to infold the bottom flaps of the set-up carton.

19 Claims, 6 Drawing Figures

CARTON ERECTOR APPARATUS

BACKGROUND OF THE INVENTION

This invention relates to carton erecting apparatus for setting up foldable carton blanks having side and end panels and top and bottom flaps integral therewith, and more particularly to apparatus for setting up carton blanks which are supplied to the apparatus in knocked-down form, and subsequently folding their bottom flaps.

Conventional foldable shipping containers of the rectangular four-flap type are typically manufactured from a single piece of cardboard, corrugated board, or the like, cut into a predetermined pattern and provided with indented fold lines to facilitate folding into a rectangular carton. The manufacturer usually folds the cardboard pattern once to bring two opposite edges together and then joins these two edges, such as with a strip of adhesive tape for example, to thereby form what is commonly known as a "manufacturer's joint". When the carton is set-up for use, the manufacturer's joint is at a corner defined by the meeting of an end panel and a side panel of the carton.

The carton manufacturer ships the carton blank in this compact form, each carton blank being a sheet of corrugated board folded in half and having the free ends joined by a manufacturer's joint. This compact folded configuration is designated in the art, and in the following specification and claims, by the term "knocked-down." Upon receipt by the user, each carton must be set-up by opening it to a rectangular shape and then folding the bottom flaps inwardly to a closed position. The bottom flaps are then typically maintained in the closed position by gluing, by a strip of gummed tape, or by stapling. The present invention is directed toward apparatus for setting up four-flap foldable cartons of the type known as RSC (regular slotted cartons), half telescope and the like.

The previously known apparatus which is designed for setting up and closing the bottom of such carton blanks, which are supplied as a knocked-down or collapsed tubularly formed carton or carton blank having side panels and bottom flaps and top flaps which are integral with the said sides, comprises a support which carries a magazine for the carton blanks, a feeding unit for pulling out and feeding a carton blank and a bottom closing means for folding in and possibly sealing the bottom flaps before the carton is filled. The feeding unit comprises a pneumatically acting catcher which is mounted perpendicularly to the feeding path and it is provided extendable so as to be able to catch a carton blank, pull same out of the magazine and together with the carton blank move along a feeding path while the carton is set-up to tubular form and the bottom flaps are infolded. At this stage the catcher is disengaged from the carton and moves back to catch another carton. In the previously known apparatus there is a first linear motion towards and away from the magazine to grasp and set-up the carton and a second linear motion perpendicular to the first linear motion to deliver the set up carton from the apparatus. These two linear motions necessitate a substantial increase in the exterior dimensions of the apparatus. Examples of such apparatus are disclosed in U.S. Pat. Nos. Re. 27,631 and 4,285,682.

SUMMARY OF THE INVENTION

The carton erecting apparatus of the present invention includes a carton blank storage section, a carton set-up section and a bottom flap folding section.

The carton blank storage section includes a magazine assembly for storing and urging knocked-down carton blanks in a substantially vertical orientation towards the carton set-up section.

The carton set-up section includes a carton opening assembly mounted on a substantially horizontal carriage plate movable in a direction transverse to the direction of movement of the cartons blanks in the magazine assembly. The carton opening assembly has a folding arm assembly and a pivot arm assembly. The folding arm assembly is pivotal about a substantially vertical shaft secured to the carriage plate and is movable between a first position generally parallel to the side panel of the forward carton blank in the magazine assembly and a second position generally perpendicular to the side panel of the carton. The pivot arm assembly is pivotably secured to the folding arm assembly and is movable between a first position substantially parallel to the folding arm assembly and a second position substantially perpendicular to the folding arm assembly.

A grasping means including at least one suction cup is secured to the pivot arm assembly for grasping the side panel of the forward carton blank from the magazine arrangement when the pivot arm assembly and the folding arm assembly are in their first positions. Subsequent movement of the pivot arm assembly and the folding arm assembly into their second positions is effective to set-up the carton blank into a tubular form with an end panel thereof in contact with the folding arm assembly. The carriage plate is movable through a substantially horizontal plane between a first position within the carton set-up section and a second position extending into the bottom flap folding section for delivery of the set-up carton thereinto.

The apparatus of the invention preferably includes bottom flap folding means for infolding the bottom flaps of the set-up carton. The bottom flap folding means includes a flap kicker assembly pivotally mounted within the carton set-up section for infolding the trailing bottom end flap of the set-up carton. A longitudinally extending plough member and a pair of converging side plough bars are mounted in the bottom flap folding section for respectively infolding the leading bottom end flap and the bottom side flaps of the set-up carton as the carton travels through the bottom flap folding section.

Further characteristics will be evident from the following detailed description in which reference will be made to the accompanying drawings.

DESCRIPTION OF A PREFERRED EMBODIMENT

Figure 1:
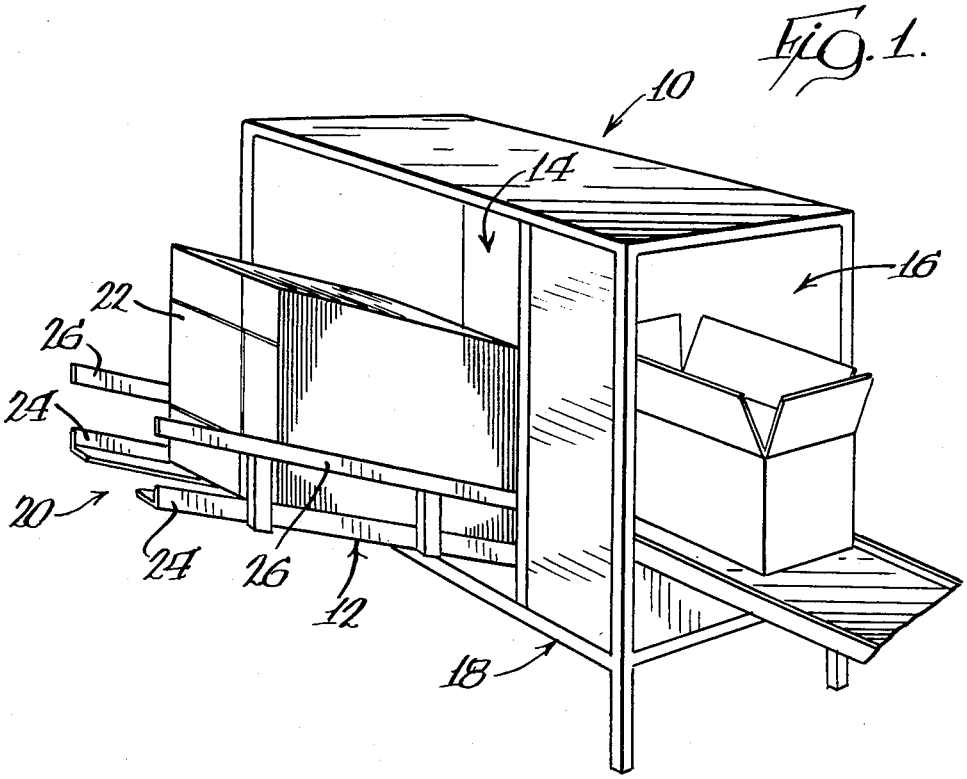
FIG. 1 is a perspective representation of a carton erector in accordance with the present invention.
Figure 5:
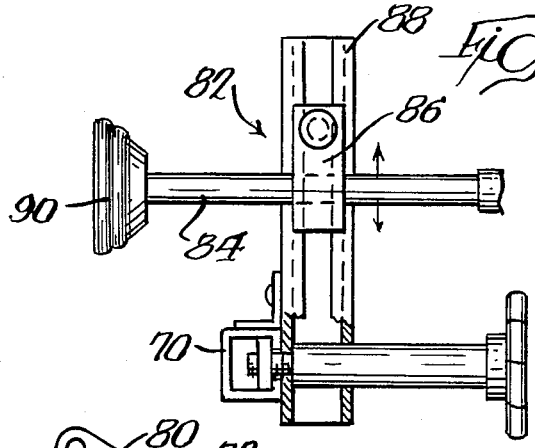
FIG. 5 is a cross sectional view taken along line 5—5 in FIG. 4.

The drawings show various views of a presently preferred embodiment of a carton erector apparatus indicated generally at 10. In order to facilitate the description of the apparatus 10, the apparatus may be functionally divided into a carton blank storage or magazine section 12, a carton set-up section 14 and a bottom flap folding section 16. The sections 12, 14 and 16 are mounted on a suitable frame structure indicated generally at 18. Referring to FIGS. 1–4, the carton blank storage section 12 extends out from one side of the frame structure 18 whereas the carton set-up section 14 and the bottom flap folding section are within the frame structure 18.

The carton blank storage section 12 includes a suitable magazine assembly 20 for supporting and individually feeding the carton blanks 22 into the carton set-up section 14. Magazine assembly 20 in a conventional manner includes inclined bottom guides 24 and side guides 26 for supporting the carton blanks 22 in a substantially vertical position. A suitable counter weight (not shown) is typically provided to urge the carton blanks towards the carton set-up section 14.

Referring to FIGS. 2–6, the carton set-up section 14 is located in facing relationship to the magazine assembly 20 for receipt of knocked-down carton blanks 22 thereinto. A substantially horizontal carriage plate 30 is mounted within a lower portion of the frame structure 18 for movement in a direction transverse to the direction of movement of the carton blanks in the magazine assembly 20. Carriage plate 30 is suitably mounted for sliding movement along guide shafts 32 and 34 rigidly secured in place to frame structure 18. The movement of carriage plate 30 is preferably controlled by a pneumatic carriage cylinder and piston assembly 36, wherein the cylinder portion 38 is secured to the underside of the carriage plate 30 and the piston portion 40 is secured to the frame structure 18. The retraction and extension of the piston portion 40 is effective to respectively move the carriage plate 30 between a first position within the carton set-up section 14 and a second position extending into the bottom flap folding section 16.

A carton blank opening assembly 42 is mounted on carriage plate 30 for receiving a knocked-down carton blank from the magazine assembly 20 and opening the carton blank into an open tubular form for subsequent delivery to the bottom flap folding section 16. Assembly 42 includes a folding arm assembly 44 and a pivot arm assembly 46.

Figure 2:
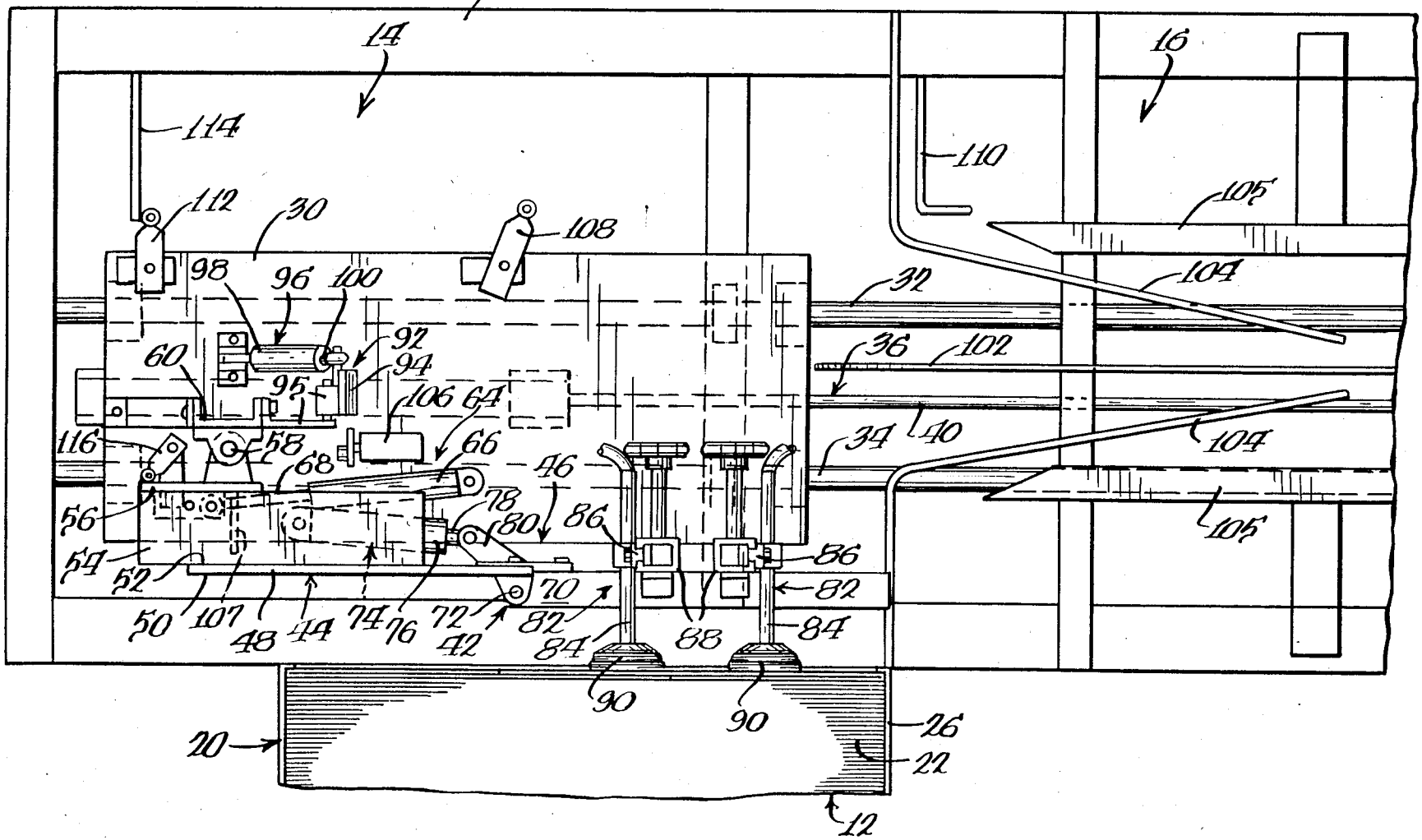
FIG. 2 is a partial plan view of a carton erector constructed in accordance with a preferred embodiment of the invention, with the folding arm assembly and the pivot arm assembly shown in their first positions.
Figure 3:
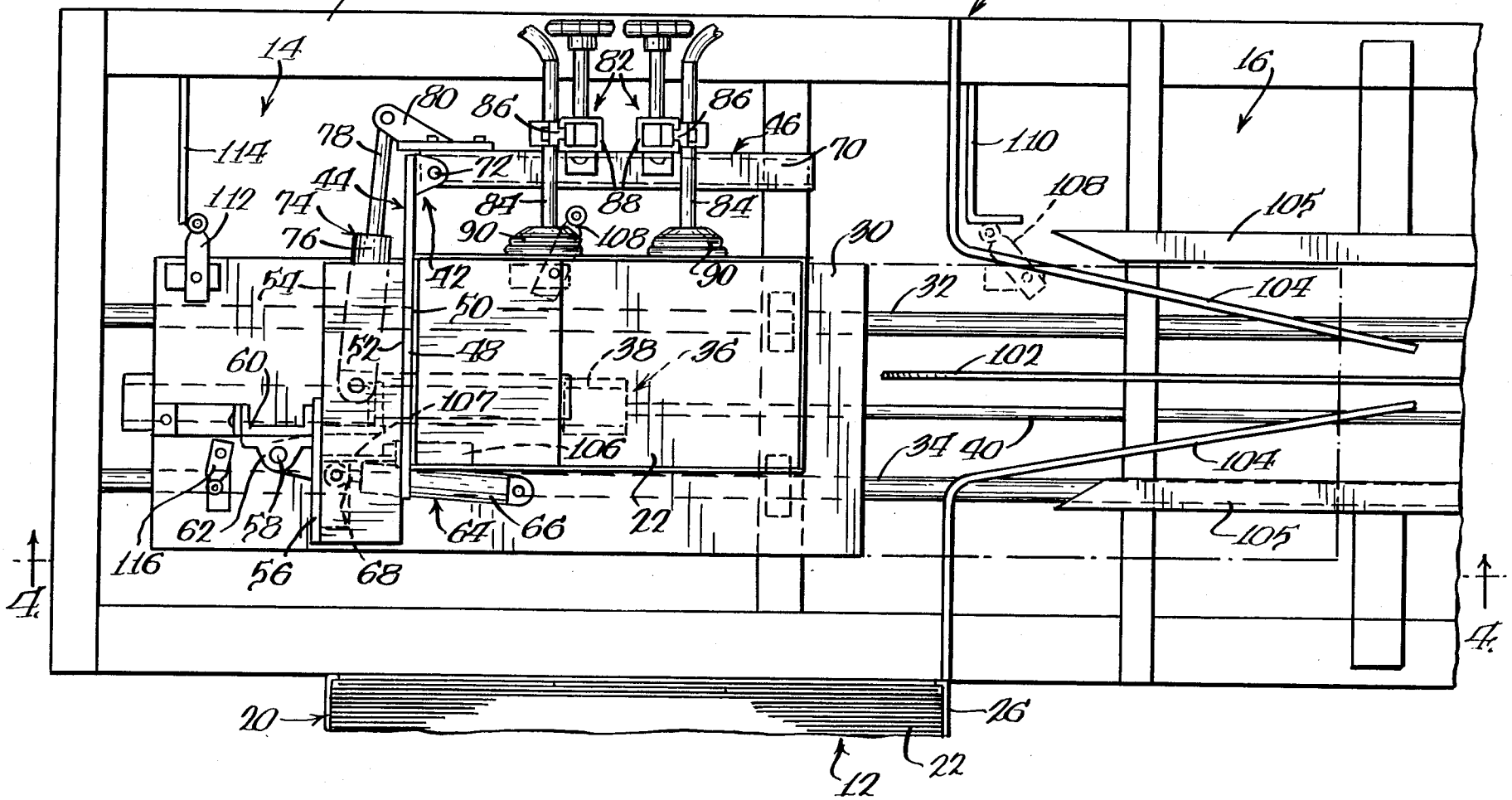
FIG. 3 is a similar view to FIG. 2 with the folding arm assembly and the pivot arm assembly in their second positions and a set-up carton shown therein.

Folding arm assembly 44 includes a folding arm or plate 48 having a vertically extending front surface 50 and a rear surface 52, which is slidably secured to a pair of vertically spaced apart channel-shaped support members 54 by clamping means 55 extending therethrough and into members 54. Support members 54 are secured to a vertically extending plate 56 which in turn is suitably secured to a vertically extending shaft 58 for rotational movement therewith. Shaft 58 is rotatably mounted to the carriage plate 30 through an upstanding support member 60 secured at its lower end to the carriage plate 30. Shaft 58 extends through upper and lower bearings 62 secured to the support member 60. The pivotal movement of the folding arm assembly 44 about the vertical axis through shaft 58 is perferably controlled by a pneumatic folding arm cylinder and piston assembly 64, wherein the cylinder portion 66 is secured to the carriage plate 30 and the piston portion 68 is suitably secured to plate 56. The extension and retraction of piston portion 68 is effective to respectively pivot folding arm assembly 44 between a first position wherein the front surface 50 is generally parallel to a side panel of the forward knocked-down carton blank in the magazine assembly 20, as seen in FIG. 2, and a second position wherein the front surface 50 is generally perpendicular to such side panel, as seen in FIG. 3.

Figure 6:
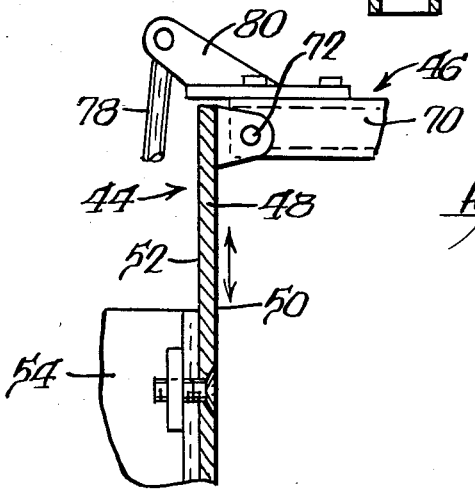
FIG. 6 is a cross sectional view taken along line 6—6 in FIG. 4.
Figure 4:
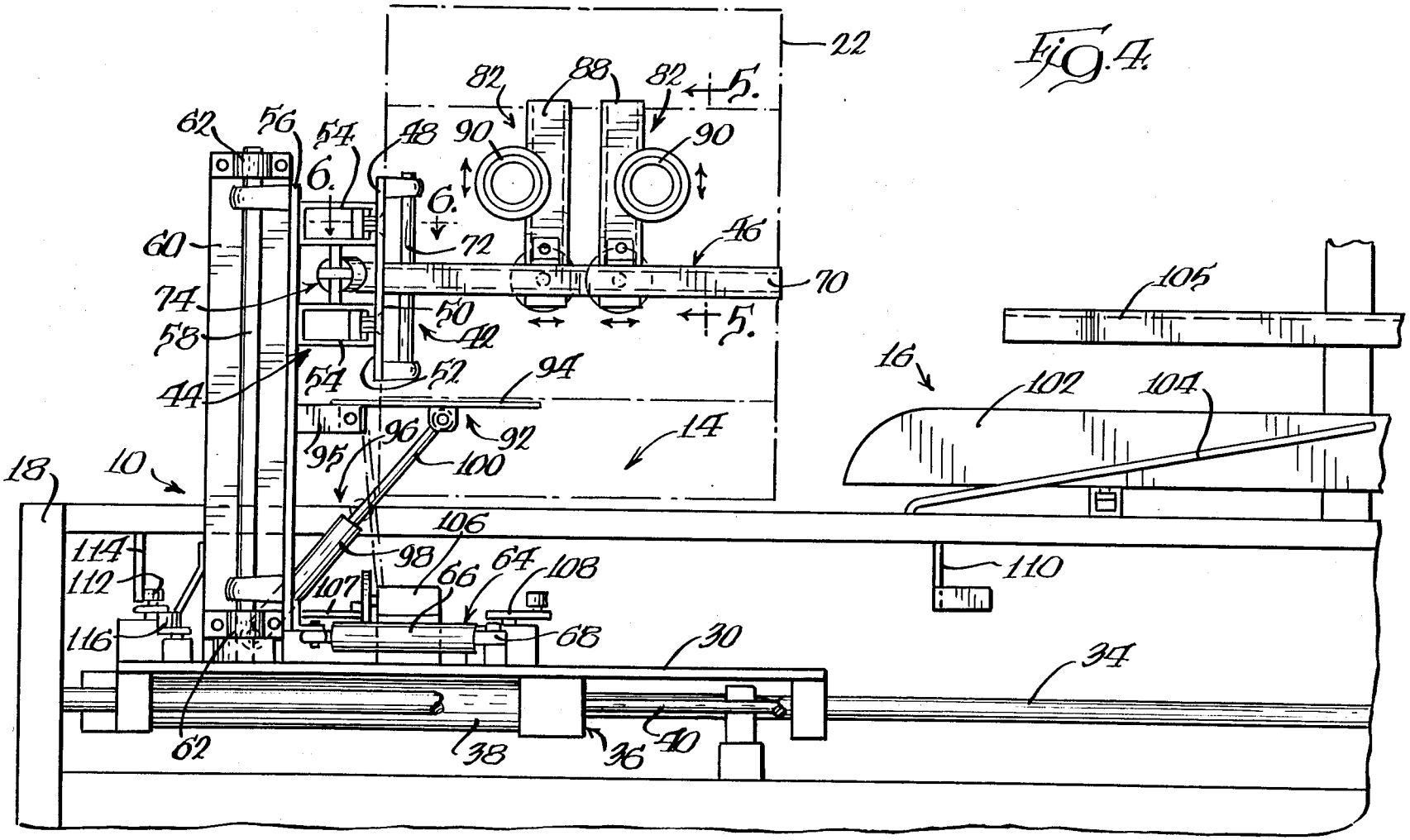
FIG. 4 is an elevational view, partially broken away, of the carton erector as illustrated in FIG. 3 with a set-up carton shown therein in phantom lines.

Pivot arm assembly 46 includes a generally horizontally extending channel shaped pivot arm member 70 which is pivotally secured at the inner end thereof to folding arm 48 of folding arm assembly 44. Referring to FIGS. 4 and 6, the inner end of pivot arm 70 is secured to a vertical shaft 72 which in turn is rotatably received in upper and lower bearings 74 secured to surface 50 of folding arm 48. The pivotal movement of the pivot arm 70 about a vertical axis through shaft 72, relative to the folding arm assembly 44, is preferably controlled by a pneumatic pivot arm cylinder and piston assembly 74, wherein the cylinder portion 76 is suitably pivotally secured between the support members 54 and the piston portion 78 is pivotally secure to the inner end of pivot arm 70 through a pair of crank plates 80 secured to pivot arm 70. The retraction and the extension of the piston portion 78 is effective to respectively pivot arm 70 between a first position substantially parallel to folding arm 48, as seen in FIG. 2, and a second portion substantially perpendicular to folding arm 48, as seen in FIG. 4.

A pair of suction cup assemblies 82 are mounted to pivot arm 70 for movement therewith. Assembly 82 includes a suction cup member 84 which is in communication with a source of vacuum (not shown). Suction cup member 84 is secured to a bracket 86, which in turn is secured to a substantially vertical channel member 88 secured to pivot arm 70. Suction cup member 84 is preferably vertically adjustable through the selective positioning of bracket 86 within channel member 88. Suction cup member 84 is preferably horizontally adjustable through the selective positioning of channel member 88 relative to pivot arm 70. The suction cup portions 90 of suction cup members 84 extend forward of channel member 70 toward the forward carton blank in the magazine assembly 20 when the pivot arm 70 is in its first position such that upon the application of vacuum thereto the suction cup portions 90 grasp the side panel of the carton blank.

A bottom flap kicker assembly 92 is pivotally mounted within the carton set-up section 14. Kicker assembly 92 includes a kicker plate 94 that is pivotally mounted to a bracket 95, which in turn is secured to support member 60. Kicker plate 94 is preferably controlled by a pneumatic kicker cylinder and piston assembly 96, wherein the cylinder portion 98 is pivotally secured to carriage plate 30 and the piston portion 100 is pivotally secured to the kicker plate 94. It is readily apparent that the extension and retraction of the piston portion 100 is effective to respectively move the kicker plate 94 between a substantially horizontal position to infold the trailing bottom end flap of a carton, as seen in FIG. 4, and a substantially vertical position, as shown in FIG. 2.

The bottom flap folding section 16 is provided with bottom flap folding means to infold the bottom side flaps and the leading bottom end flap of a set-up carton which is delivered thereinto by the carriage plate 30. A longitudinally extending plough member 102 is mounted to frame structure 18 for infolding the leading bottom end flap of the carton in a conventional manner. A pair of converging side plough bars 104 are mounted to the frame structure 18 for infolding the bottom side flaps in a conventional manner.

A pair of spaced apart side guide rails 105 are supported within bottom flap closing section 16. Guide rails 105 are preferably vertically and horizontally adjustable in a suitable manner to permit the guiding of various sizes of cartons therethrough. Although not specifically shown, guide rails 105 may be provided with powered conveyor means to contact the side panels of a set-up carton and direct same through section 16.

The sequential operation of the pneumatic cylinder assemblies 36, 64, 74, and 96 are controlled by limit switches positioned on carriage plate 30 to control power valves (not shown) in a conventional pneumatic circuit (not shown) in a manner which will hereinbelow become more apparent in the discussion of the operation of carton erector apparatus 10. A first limit switch 106 is suitably positioned on carriage plate 30 to control the extension of the piston portion 40 of assembly 37 and thereby move the carriage plate 30 into its second position as the folding arm 48 is moved into its second position. Limit switch 106 also controls the extension of the piston portion 100 of assembly 96 and thereby moves the kicker plate 94 into its horizontal position as the folding arm 48 is moved into its second position. The first limit switch 106 is activated by a control pin 107 secured to folding arm 48.

A second limit switch 108 is suitably positioned on carriage plate 30 for closing off the source of vacuum to the suction cup members 84 as the carriage plate moves into its second position. The second limit switch 108 also controls the retraction of the piston portion 78 of assembly 74 and thereby moves the pivot arm assembly 46 into its first position as the carriage plate moves into its second position. The second limit switch 108 also controls the retraction of the piston portion 100 of assembly 96 and thereby moves the kicker plate 94 into its vertical position as the carriage plate moves into its second position. The second limit switch 108 further controls the retraction of the piston portion 40 of assembly 36 and thereby returns the carriage plate 30 back to its first position. A detent member 110 is secured to frame structure 18 to contact and activate switch 108 as the switch 110 comes into contact therewith during movement of the carriage plate 30 into its second position. The longitudinally extending portion of detent 110 maintains the switch in its activated position for a short period of time, during which time the operations discussed immediately above are initiated. As the carriage member 30 starts to return to its first position, the limit switch leaves contact with detent 110 and returns to an inactive position which is effective to again open the source of vacuum to the suction cup members 84.

A third limit switch 112 is suitably positioned on carriage plate 30 to control the extension of the piston portion 68 of assembly 64 to move the folding arm assembly 44 into its first position as the carriage plate 30 returns to its first position. A detent 114 is secured to frame structure 18 to contact and activate switch 112 as the switch 112 comes into contact therewith during movement of the carriage plate 30 into its first position.

A fourth limit switch 116 is suitably positioned on carriage plate 30 to control the retraction of piston portion 68 and the extension of piston portion 78 and thereby respectively initiate the return of the folding arm assembly 44 and the pivot arm assembly 46 into their second position as the folding arm assembly 44 reaches its first position. Limit switch 116 is activated as the plate 56 comes in contact therewith as the folding arm assembly 44 reaches its first position.

The operating cycle of erector apparatus 10 will now be described by tracing the passage of a carton 22 through the apparatus.

To prepare the apparatus for operation the magazine assembly 20 is loaded with a plurality of knocked-down carton blanks which are inserted in the magazine so that they are all vertically oriented and aligned in the same direction. The carton blanks are aligned in such a direction that their side panels have an end fold at the left, as shown in FIG. 1. In setting up the apparatus the members 24 and 26 of magazine assembly 20 are set to the overall width of the knocked-down carton blanks in a well known manner. The members 24 of magazine assembly 20 are suitably adjusted to present the carton blanks to the carton set-up section 14 so that the bottom fold lines of the cartons (which will be at the carton bottom when the bottom flaps are subsequently infolded) will be at the same height as the kicker plate 94 when it is in its horizontal position. The guide rails 105 are suitably adjusted for receipt of the specific carton size loaded in the magazine assembly 20. The folding arm 48 is adjusted relative to the support members 54 to align the longitudinal center line of the set-up carton with the plough member 102.

At the start of the operating cycle, the apparatus 10 is positioned as shown in FIG. 2. That is, the carriage plate 30, the folding arm assembly 44 and the pivot arm assembly 46 are in their first positions, and the kicker plate 94 is in its vertical position. Also, the plate 56 is in activating contact with switch 116 and the detent 114 is in activating contact with switch 112.

With apparatus 10 so positioned, upon turning the apparatus to the "on" position, a source of vacuum is supplied to the suction cup members 84 which causes the suction cups 90 to grasp the side panel of the forward carton blank in the magazine assembly 20. Simultaneously therewith, the folding arm assembly 44 and the pivot arm assembly 46 are moved into their second positions by the respective cylinder assemblies 64 and 74, in the manner as hereinabove discussed, as is shown in solid lines in FIG. 3. As the folding arm assembly 44 and pivot arm assembly move into their second positions the leading carton blank is pulled from the magazine assembly 20 inwardly into the carton set-up section 14 by the inward movement of suction cups 90 in grasping contact with the side panel of the carton. The pivotal movement of the folding arm 48 causes surface 50 to contact the trailing end panel of the carton and open the carton blank into a tubular set-up form as the folding arm assembly 44 and the pivot arm assembly simultaneously reach their second positions.

As the folding arm assembly 44 reaches its second position, pin 107 contacts and activates switch 106, which simultaneously causes cylinder assembly 96 to move the kicker plate 94 to its horizontal position infolding the trailing bottom end flap and the cylinder assembly to 36 to start movement of the carriage assembly 30 towards its second position to deliver the set-up carton to the bottom flap closing section 16, in the manner as hereinabove described, as is shown in phantom lines in FIG. 3.

As the carriage plate 30 reaches it second position delivering the set-up carton to the bottom flap folding section 16, detent 110 contacts and actuates switch 108 controlling the initiation of a series of operations. The source of vacuum to the suction cup members 84 is shut off releasing the set-up carton therefrom. The cylinder assembly 74 initiates the movement of the pivot arm assembly 46 to return to its first position. The cylinder assembly 96 initiates the movement of the kicker plate assembly 92 to return the kicker plate 94 to its vertical position. The cylinder assembly 36 initiates movement of the carriage plate 30 to return the carriage plate 30 to its first position.

The set-up carton in the bottom flap folding section 16 is conveyed by suitable conveying means (not shown) to move the set-up carton through the section 16. As the set-up carton travels through the section 16, the plough 102 contacts and infolds the leading bottom lap and the side plough members 104 contact and infold the side bottom flaps. Accordingly, the carton exiting from the carton erector 10 is set-up and all of the bottom flaps are infolded.

As the carriage plate 30 leaves the carton set-up section 16, the switch 108 is released from contact with detent 110 and returns to its initial position resulting in the return of the supply of vacuum to suction cup members 84. As carriage plate 30 returns to its first position within carton set-up section 14, detent 114 contacts and activates switch 112 and the cylinder assembly 64 pivots the folding arm assembly back into its first position. The components of the carton erector assembly are now in their initial position ready to grasp the next carton blank and repeat the operating cycle.

Thus, there has been described a novel carton erecting apparatus which facilitates the setting up of knocked-down carton blanks. Although the invention has been described with the requisite degree of particularity, it is understood that the present disclosure has been made only by way of example and that numerous changes in the details of construction and the combination and arrangement of parts may be resorted to without departing from the spirit and scope of the invention as hereinafter claimed.

What is claimed is:

1. Carton erecting apparatus for setting up and bottom closing of cartons which are supplied to the apparatus as knocked-down carton blanks having side and end panels and top and bottom flaps formed integral therewith; said apparatus comprising:

(a) a carton blank storage section having a magazine means for storing and urging knock-down carton blanks in a substantially vertical orientation with their bottom flaps lowermost towards a carton set-up section;

(b) said carton set-up section including a carton opoening assembly for receiving a carton blank from said magazine means in a substantially vertical orientation and setting up said carton blank in a tubular form, said carton opening assembly having a folding arm and a pivot arm, said folding arm being pivotal about a substantially vertical axis and movable between a first position generally parallel to the side panel of said knocked-down carton blank in said magazine means and a second position generally perpendicular to the side panel of said knocked-down carton blank, said pivot arm being pivotally secured to said folding arm and movable between a first position substantially parallel to said folding arm and a second position substantially perpendicular to said folding arm, said carton opening assembly having a first means for moving said folding arm between its first and second positions, said carton opening assembly having a second means for moving said pivot arm between its first and second positions, said carton opening assembly having a grasping means associated with said pivot arm for grasping a side panel of said carton blank from said magazine means when said pivot arm and said folding arm are in their respective first positions such that upon subsequent movement of said pivot arm and said folding arm into their respective second positions an end panel of said carton blank contacts said folding arm urging said carton blank into a set-up tubular form, said folding arm being secured to a first substantially vertical shaft rotatably mounted to a substantially horizontal carriage plate extending under and secured to said carton opening assembly, said carriage plate being movable through a substantially horizontal plane by a third means connected to said carriage plate between a first position within said carton set-up section and a second position extending into a bottom flap folding section for delivery of the set up carton thereinto; and said apparatus having a bottom flap folding means associated therewith for infolding the bottom flaps of the set-up carton.

2. The invention as defined in claim 1 wherein said first means is a pneumatic cylinder means in said carton set-up section for movement of said folding arm between its first and second positions about said first shaft.

3. The invention as defined in claim 1 wherein said pivot arm is secured to a second substantially vertical shaft rotatably secured to said folding arm.

4. The invention as defined in claim 3 wherein said second means is a pneumatic cylinder means in said carton set-up section for movement of said pivot arm between its first and second positions about said second shaft.

5. The invention as defined in claim 1 wherein said third means is a pneumatic cylinder means.

6. The invention as defined in claim 1 wherein said bottom flap folding means includes a flap kicker member pivotally mounted to said carriage plate and movable by fourth means connected to said flap kicker member between a substantially vertical position, when said folding arm and said pivot arm are in their first positions, and a substantially horizontal position to infold the trailing bottom end flap of the carton, when said folding arm and said pivot arm are in their second positions.

7. The invention as defined in claim 1 wherein said bottom flap folding means includes a longitudinally extending plough member mounted in said bottom flap folding section for infolding the leading bottom end flap of the carton as the carton travels therethrough.

8. The invention as defined in claim 7 wherein said bottom flap folding means further includes a pair of converging side plough bars mounted in said bottom flap folding section for infolding the bottom side flaps of the carton as the carton travels therethrough.

9. The invention as defined in claim 1 wherein said grasping means includes at least one suction cup in communication with source of vacuum for grasping the side panel of said carton blank.

10. The invention as defined in claim 9 wherein said suction cup is selectively vertically and horizontally adjustable relative to said pivot arm.

11. The invention as defined in claim 6 including first switch means positioned on said carriage plate for automatically activating said third means for movement of said carriage plate from said carton set-up section towards said bottom flap folding section as said folding arm is moved into its second position.

12. The invention as defined in claim 11 wherein said first switch means further activates said fourth means and moves said kicker member into its horizontal position.

13. The invention as defined in claim 11 further including second switch means positioned on said carriage plate for releasing said grasping means as said carriage plate reaches its second position.

14. The invention as defined in claim 13 wherein said second switch means further activates said second means and moves said pivot arm towards its first position.

15. The invention as defined in claim 13 wherein said second switch means further actuates said fourth means and moves said kicker member towards its vertical position.

16. The invention as defined in claim 13 wherein said second switch means actuates said first means and moves said carriage plate towards its first position.

17. The invention as defined in claim 13 wherein as said carriage plate moves towards its first position said second switch means activates said grasping means.

18. The invention as defined in claim 13 further including third switch means positioned on said carriage plate for activating said first means and moving said folding arm towards its first position as said carriage plate moves towards its first position.

19. The invention as defined in claim 18 further including fourth switch means positioned on said carriage plate for activating said first and second means so as to move said folding arm and said pivot arm into their second position as said carriage plate reaches its first position and grasps a carton.

* * * * *